US005237708A

United States Patent [19]

Zamoyski

[11] Patent Number: 5,237,708

[45] Date of Patent: Aug. 24, 1993

[54] FOOT ACTUATED TOILET SEAT LIFTING, ANTI-SLAMMING, AND RESEATING DEVICE

[76] Inventor: Mark Zamoyski, 988 Foothill Dr., San Jose, Calif. 95123

[21] Appl. No.: 985,834

[22] Filed: Dec. 3, 1992

[51] Int. Cl.[5] ..... A47K 13/10

[52] U.S. Cl. ..... 4/246.3; 4/246.1; 4/248

[58] Field of Search ..... 4/246.1, 246.2, 246.3, 4/246.4, 246.5, 248; 220/262, 263, 264

[56] References Cited

U.S. PATENT DOCUMENTS

| | | | |
|---|---|---|---|
| 765,643 | 7/1904 | Tregoning | 4/246.4 |
| 1,505,472 | 8/1924 | Kuno | 4/251 |
| 1,999,070 | 4/1935 | Svedelius | 4/251 |
| 2,410,854 | 11/1946 | Zulkoski | 4/251 |
| 3,055,016 | 9/1962 | Kemp | 4/251 |
| 3,303,517 | 2/1967 | Wood et al. | 4/246.4 |
| 3,417,411 | 12/1968 | Greenwood | 4/251 |
| 3,504,385 | 4/1970 | Fields | 4/251 |
| 3,516,095 | 6/1970 | Clifton et al. | 4/246.5 |
| 4,030,146 | 6/1977 | Pilkington | 4/251 |
| 4,103,371 | 8/1978 | Wilson | 4/251 |
| 4,150,446 | 4/1979 | Crocker | 4/251 |
| 4,426,743 | 1/1984 | Seabrooke | 4/251 |
| 4,470,161 | 9/1984 | Seabrooke | 4/251 |
| 4,649,576 | 3/1987 | Lillie | 4/251 |
| 4,975,988 | 12/1990 | Won | 4/251 |

FOREIGN PATENT DOCUMENTS

| | | | |
|---|---|---|---|
| 487892 | 12/1929 | Fed. Rep. of Germany | 4/246.4 |

*Primary Examiner*—Henry J. Recla
*Assistant Examiner*—Charles Eloshway

[57] ABSTRACT

A foot actuated toilet seat lifting, anti-slamming, and reseating device that functions exceptionally well over a wide range of user foot pressure variations or abruptness. The base member is substantially a lever pivotally attached to a fulcrum. The lever has a resilient material attached at the foot receiving end, an adjustable lifting rod pivotally attached at the opposite end, and a pneumatic device adjustably and pivotally attachable in between. Both the rod and pneumatic device extend upward and are pivotally attached to the toilet seat by a bracket. The pneumatic device does not provide resistance as the seat is lifted, dampens then stops the seat at the desired lift climax preventing slamming, and then provides a gentle return of the seat without slamming even if the users foot is abruptly removed. The resilient material on the foot receiving end feels good as well as aiding damping at lift climax, and aiding in return of the seat.

6 Claims, 2 Drawing Sheets

FOOT ACTUATED TOILET SEAT LIFTING, ANTI-SLAMMING, AND RESEATING DEVICE

BACKGROUND—FIELD OF THE INVENTION

This invention relates to the field of toilet seat lifters, and more specifically, to toilet seat lifters operated by application of pressure by the user's foot.

Many prior art foot actuated toilet seat lifting devices are known, employing levers, rods cables, air and fluid displacing pistons. The force of the users foot is transmitted to the toilet seat, so that the seat is lifted without the inconvenience of bending over and without any possible health risk from hand contact with the seat.

None of the prior art devices have achieved wide acceptance and use in the United States. This lack of acceptance and use is believed to be due, at least in part, to several disadvantages inherent in the design of prior art devices. These disadvantages relate to a lack of acceptable operation over a wide range of user conditions, mechanical complexity that makes them too expensive, and the need for elaborate installation procedures that are unacceptable to customers. Although most of the prior art devices are utilitarian and functional in lifting the toilet seat they lack the adequate or cost effective design to also 1) prevent the seat from slamming into the lid if the user abruptly applies force to the device and 2) allow the gentle return of the seat even when the user's foot is abruptly removed from the device. Devices such as that disclosed in U.S. Pat. No. 4,030,146 of Pilkington and U.S. Pat. No. 4,649,576 of Lillie provide no protection against slamming during abrupt seat lift and only damp the force associated with lowering of the seat but do not prevent the slamming back down of the seat if the user's foot is abruptly removed from the device. U.S. Pat. No. 3,055,016 of Kemp uses multiple levers and foot pedals, complex linkages, does not provide for adjustability of the air cylinder to different height toilets, and is very difficult to install. U.S. Pat. No. 3,504,385 of Fields positions a cylinder vertically behind the lifting arm which seriously limits its anti slamming down protection capability. The prior art devices make no provision for user comfort such as if the user is barefoot when using the toilet in the middle of the night. Devices such as U.S. Pat. Nos. 4,975,988 of Won, and 4,426,743 and 4,470,161 of Seabrooke, are so mechanically complex (consequently expensive) and require such elaborate installation procedures that they are commercially unviable.

A simple, inexpensive, readily installable, easily adjustable device is needed that provides a smooth lift without slamming, prevents the seat from being left up, and provides a gentle return of the toilet seat regardless of the abruptness or variations in pressure exerted by the user on the device. The device must also feel soft and comfortable to use.

OBJECTS AND ADVANTAGES OF THE INVENTION

It is an object of the invention to provide improved user friendless of the device so that the device will lift the seat smoothly, prevent the seat from slamming open, prevent the seat from being left up, and lower the seat gently preventing it from slamming down on the bowl. It is an object of the invention to provide the above described operations over a wide range of variations and abruptness in foot pressure provided by the user.

Another object of the invention to provide improved user feel of the device to make it feel soft and comfortable to use even when the user is not wearing shoes.

Another object of the invention is to provide a commercially acceptable product that is affordable, quickly installable, readily adjustable to various toilets.

SUMMARY OF THE INVENTION

Briefly, the preferred embodiment of the present invention includes a lever on a fulcrum which rests on the floor by the side of a toilet. A pivoting lifting rod and pneumatic device extend upward from the lever and attach to a bracket on the toilet seat. A resilient material surrounds the foot-receiving portion of the lever.

The various elements of the system interact as follows to provide a smooth lift, prevent slamming up, and provide a gentle re-seating without slamming down. As force from the user's foot is applied to the foot-receiving portion of the lever the lifting rod starts lifting the toilet seat and toilet seat attachment bracket. As the toilet seat attachment bracket moves upward it pulls the pistons of the pneumatic device apart from each other (extended outward) and a one way valve allows air to fill the void created between the pistons. As the toilet seat approaches the climax of the desired lift a resilient material on the foot-receiving portion or in the pneumatic device or from both sources begins compressing and stopping the lift. At the desired climax of the seat lift the pistons of the pneumatic device are fully extended outwards preventing the seat from going beyond the desired climax lifting point thus preventing slamming. When the foot is removed from the lifting device the seat starts to fall, either by gravity or by decompression of the resilient material mentioned above. As the seat and seat bracket move downward the one way valves in the pneumatic device close forcing a compressions of air inside the pneumatic device which by itself would completely arrest the downward motion of the seat at some point. A small hole in one of the valves in the pneumatic device allows the air to escape slowly providing a controlled, gently return of the seat to the bowl without slamming down.

DETAILED STATIC DESCRIPTION OF INVENTION

Figure 1:
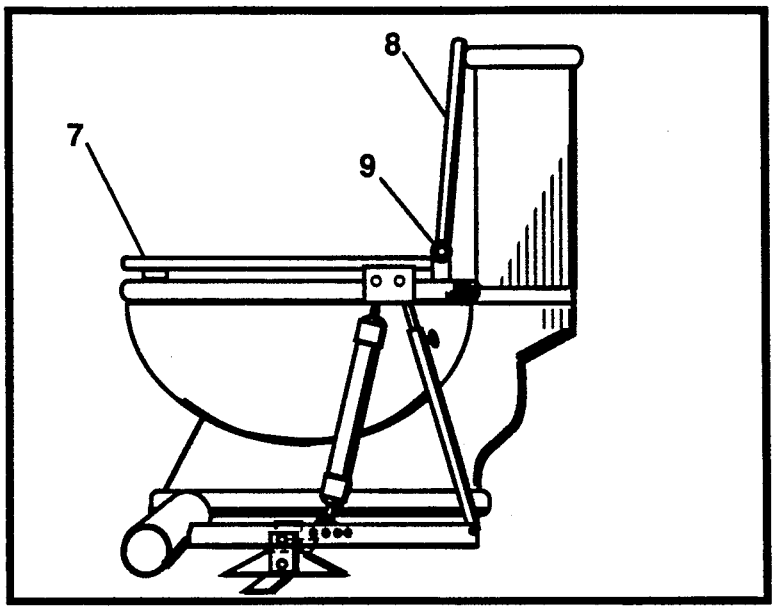
FIG. 1 is a side view of the lifting device attached to a toilet.

In accordance with the preferred embodiment of the present invention FIG. 1 shows a toilet seat lifting device 6 attached to a toilet seat 7 and toilet cover 8 which in turn are attached to the toilet by hinges 9.

Figure 2:
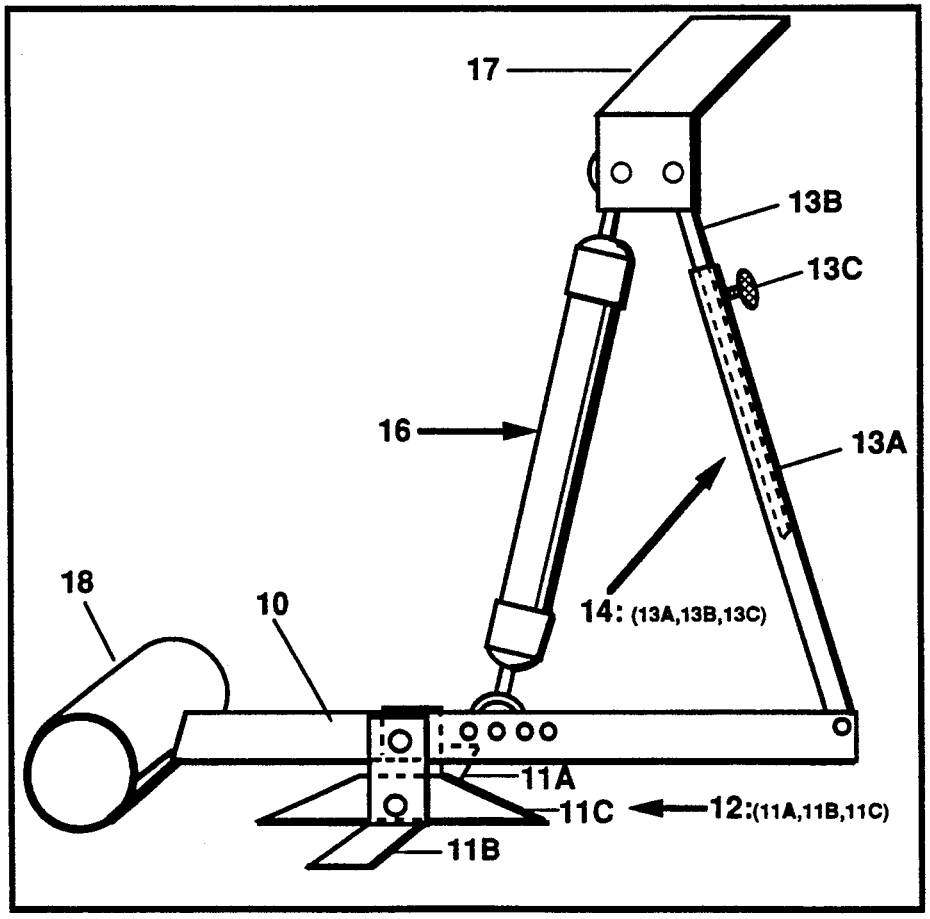
FIG. 2 is a side view of the lifting device itself.

FIG. 2 shows the toilet seat lifting device which employs a base member which is basically a lever 10 pivotally connected to a fulcrum 12. Fulcrum 12 is made from two back to back substantially right angle pieces 11A, 11B between which a fulcrum stabilizer or counter lever 11C is attached. Fulcrum stabilizer 11C has a shape that can be trapezoidal, triangular, rectangular or any other suitable shape and is oriented dimensionally in the same plane as lever 10. A conventional fulcrum may also be used in place of fulcrum 12. The floor engaging side of fulcrum 12, may be attached to a floor with mounting tape, adhesives, fasteners, or not attached and a non-skid material may be used. A pipe segment or hollow rod 13A is attached pivotally at the far end of lever 10 and extends upwards. A eye bolt or similarly bent rod 13B is inserted into pipe segment 13A. A thumb screw 13C screws into a threaded hole in pipe segment 13A creating an adjustable lifting rod 14. As thumb screw 13C is unscrewed eye bolt 13B is free to move and may be adjusted to the desired length. When thumb screw 13C is screwed back in the pressure on eye bolt 13B prevents eye bolt 13B from moving. Eye bolt 13B is pivotally connected to a toilet seat attachment bracket 17. Toilet seat attachment bracket 17 may be attached to the underside of a toilet seat 7 by means of mounting tape, adhesives, screws or other fasteners. One end of a pneumatic device 16 is pivotally attached to a toilet seat attachment bracket 17 either next to or together with lifting rod eve bolt 13B. The other side of pneumatic device 16 attaches pivotally to one of several possible attachment points along lever 10. Both pivotal and non pivotal attachments are accomplished by the use of bolts, thumb screws, nuts, lock nuts, wing nuts, washers and fender washers but any suitable means may be substituted. As an example the eye bolts are pivotally attached by a stack of washers inside the eye portion of the eye bolt that have an outside diameter smaller than the inside diameter of the eye and in aggregate have a thickness greater than the diameter of the rod portion of the eye bolt. These in turn are bounded by fender washers on both sides and attached by a nut and bolt to either lever 10 or toilet seat attachment bracket 17, however any other suitable means may be substituted.

Figure 3A:
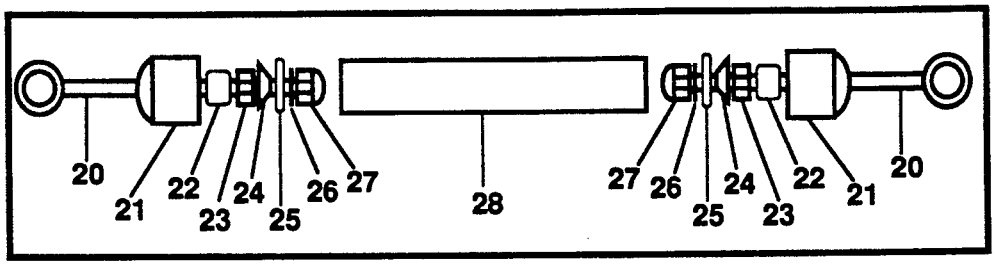
FIGS. 3A to 3D show an exploded view of the pneumatic device, the position of the piston and valve components upon outward and inward motion, and a isometric view of the piston and valve components.

FIG. 3A shows an exploded side view of pneumatic device 16. The housing surrounding the pistons is made up of a cylinder 28 and two end caps 21. Cylinder 28 can be made using PVC, ABS, a metal cylinder or any other suitable material. End caps 21 can also be made of PVC, ABS, metal or other suitable material and adhered to cylinder 28 by either adhesives, threads, pressure, or any other suitable means. A hole drilled in end cap 21 allows it to be slid onto a eye bolt or similarly bent rod 20. Eye bolt 20 is threaded on one end and is bent around to form an approximate circle on the other end. Eye bolt 20 forms the shaft on which the piston and valve components reside. Moving from the eye part of eye bolt 20 to the threaded end the following components appear: end cap 21, a resilient component 22, a nut 23, a beveled washer 24, a piston washer 25, a non resilient washer 26, and a lock or aero nut 27. Resilient component 22 may be made of foam rubber, neoprene, a spring or any other suitable material. Nuts 23 and 27 may also be substituted with a jam nuts, lock nuts, or substituted with C rings, compression rings, cotter pins or any suitable means if a thread is not used. Washers 24 and 25 may me made from neoprene, rubber, plastic, metal or any other suitable material. The inside diameter of the hole through the center of piston washer 25 and non resilient washer 26 is greater than the outside diameter of the shaft part of eye bolt 20. The inside diameter of the hole through the center of beveled washer 24 is smaller than the outside diameter of the shaft part of eye bolt 20 so that no air may pass between them. In all FIGS. 3A, 3B, 3C and 3D the spacing of the components has been exaggerated for clarity. Other embodiments of the pneumatic device could include a single piston version without the resilient component 22 if a completely unidirectional resistance device is desired.

Figure 3B:
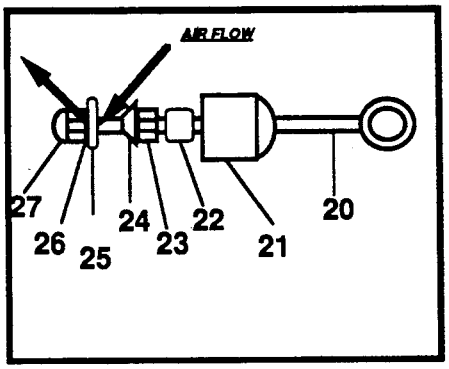

FIG. 3B shows the position of the components when eye bolts 20 are pulled outwards or extended. Piston washer 25 presses against non resilient washer 26. Air is free to flow through the inside hole of piston washer 25, non resilient washer 26 and then out through the imperfect seal between non resilient washer 26 and lock nut 27. If faster air flow is desired washer 26 may be serrated, bowed, perforated or likewise modified to create more or larger air channels between non resilient washer 26 and lock nut 27.

Figure 3C:
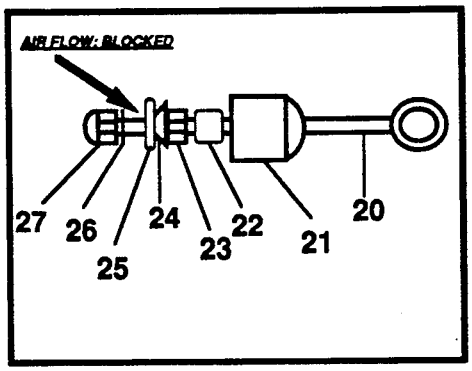

FIG. 3C shows the position of the components when eye bolts 20 are pushed inwards or compressed. Piston washer 25 presses against beveled washer 24 forming an air tight seal. The continued inwards motion compresses the air between the two piston washers 25. To allow for a gradual release of this compressed air a small diameter hole is made through one of the beveled washers 24. This hole extends diagonally from above the outside diameter of nut 23 to below the inside diameter of piston washer 25. Other embodiments of the air pressure release mechanism could include a hole in the cylinder, an adjustable or automatic pressure release mechanism penetrating through the cylinder wall or any other suitable means of controlled pressure release.

Figure 3D:
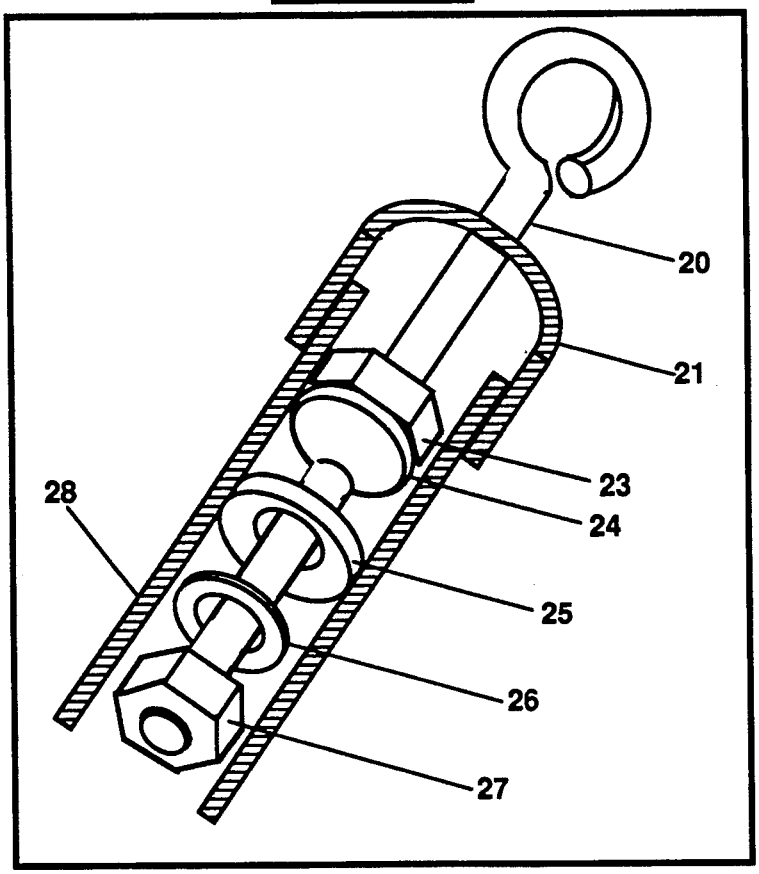

FIG. 3D shows an isometric view of the piston and valves for clarity.

DETAILED OPERATIONAL DESCRIPTION OF INVENTION

The various elements of the system interact as follows to provide a smooth lift, prevent slamming up, and provide a gentle re-seating without slamming down. As force from the user's foot is applied to foot-receiving portion 18 lever 10 transmits the force to adjustable lifting rod 14 which starts lifting toilet seat 7 and toilet seat attachment bracket 17. As toilet seat attachment bracket 17 moves upward it pulls eye bolts 20 and pistons 25 of pneumatic device 16 apart from each other (extended outwards). This motion causes piston washers 25 to assume the position diagramed in FIG. 3B which in turn allows air to enter the void created in cylinder 28 between the two piston washers 25. As the toilet seat approaches the climax of the desired lift a resilient material on foot-receiving portion 18 or resilient component 22 in pneumatic device 16 or from both sources begins compressing and stopping the lift. At the desired climax of the seat lift, eye bolts 20 of pneumatic device 16 are fully extended outwards with nuts 23 stopped by end caps 21 preventing toilet seat 7 from going beyond the desired climax lifting point and slamming into toilet cover 8. When the foot is removed from foot-receiving portion 18 toilet seat 7 starts to fall, either by gravity or by decompression of the resilient material on foot receiving portion 18 and/or decompression or resilient components 22. As toilet seat 7 and toilet seat attachment bracket 17 move downward eye bolts 20 of pneumatic device 16 are pushed inwards and piston washers 25 assume the position in FIG. 3C pressed against beveled washers 24 forming an air tight seal and compressing the air trapped between the two piston washers 25. A very small diameter hole drilled in one of beveled washers 24 allows for a slow controlled release of the compressed air allowing eye bolts 20 and toilet seat 7 to come down gently and reseat.

CONCLUSION, RAMIFICATIONS AND SCOPE OF INVENTION

The described invention provides a simple, readily installable, easily adjustable device that provides foot actuated lift of a toilet seat without slamming and a gentle return of the toilet seat without slamming, regardless of the abruptness or variations in pressure exerted by the user on the device. The invention feels soft and comfortable to use.

The device is inexpensive to manufacture employing several innovative devoces that do not require expensive tools or molds. The pneumatic device is lightweight yet can withstand very high pressures. It can be cheaply constructed from PVC pipe, PVC end caps, eye bolts, washers and nuts. Different embodiments of the pneumatic device can allow it to be used as a unidirectional resistance device, bidirectional resistance device, a mixed resistance device in one direction, and variations in the pressure relief hole size or its absence altogether make the possible combinations and potential uses very large. The fulcrum assembly can be produced from simple cut and bent metal parts. The fulcrum stabilizer or "counter lever" piece not only acts as a spacer for the lever but provides surprisingly better fulcrum stability than could be achieved by using fulcrum legs with a longer base.

While my invention contains many specificities and subordinate devices and assemblies, these should not be construed as limitations on the scope of invention or scope of use for the subordinate devices or assemblies, but rather as an exemplification of one preferred embodiment for one particular application. Many other variations and applications are possible.

I claim:

1. A foot actuated mechanism for lifting a toilet seat pivotally attached to a toilet bowl and preventing slamming of the seat against the toilet bowl during reseating comprising:

a) a single lever arm having a first foot receiving end and a second end;

b) an adjustable lifting rod having one end pivotally attached to said lever arm at said second end;

c) a fulcrum adapted to be mounted on a floor adjacent a toilet bowl, said lever arm pivotally attached to said fulcrum;

d) a pneumatic device having one end pivotally attached to said lever arm between said fulcrum and said second end, said pneumatic device expanding freely but contracting under resistance; and e) a toilet seat attachment bracket adapted to be attached to said toilet seat, and to which opposite ends of said lifting rod and said pneumatic device are pivotally attached, whereby upon pressing said foot receiving end of said lever arm, said toilet seat is lifted away from said toilet bowl and during lowering of said seat, said seat falls under its own weight against the resistance of said pneumatic device.

2. Apparatus as in claim 1 wherein said foot receiving end comprises a resilient material means for aiding in slowing the lift of the seat near climax and aiding in pivoting said lever to cause descent of the toilet seat.

3. Apparatus as in claim 1 wherein said fulcrum is comprised of:

a) two similar right angled pieces positioned back-to-back and adapted to be mounted to said floor;

b) a support piece adapted to rest perpendicular to said floor, and which is fixedly attached between said back-to-back pieces;

and wherein said lever arm is longitudinally oriented in a plane defined by said support piece and pivotally attached to said back-to-back pieces.

4. Apparatus as in claim 1 wherein said pneumatic device comprises:

a) a cylinder having at least one open end and defining an inside diameter;

b) a rod slidably disposed within said cylinder and having a first threaded end portion inside said cylinder and an opposite end portion extending through said open end to exterior of said cylinder;

c) a first nut mounted on said threaded end portion at a terminal end thereof and a second nut mounted on said threaded end portion inwardly of said first nut, a resilient piston washer mounted on said threaded end portion between said nuts, a non-resilient washer mounted on said threaded end portion between said resilient piston washer and said first nut, a resilient beveled washer mounted on said threaded portion between said resilient piston washer and said second nut;

d) said piston washer and non-resilient washer having an inside diameter hole greater than the rod and said resilient beveled washer having an inside diameter smaller than the rod;

e) said cylinder being smaller than the outside diameter of said piston washer and larger than the outside diameter of the beveled washer;

I) an end cap mounted on said open end of said cylinder having an opening through which said rod is slidably received;

II) means associated with said beveled washer for relieving pressure from said cylinder interior through said open end;

whereby upon extending said rod from said cylinder gas flows freely through said open end, around said beveled washer, through said resilient piston washer and said non-resilient washer to permit said pneumatic device to expand freely and upon contraction of said rod into said cylinder, gas is prevented from escaping from said cylinder around said beveled washer and force through said pressure relieving means to provide resistance.

5. Apparatus as in claim 1 wherein said lifting rod is comprised of a pipe segment an a slide rod, the pipe segment being pivotally connected to the lever, the slide rod inserted into the pipe and pivotally attached to said toilet seat attachment bracket, and a fastener threaded through the pipe segment to engage said slide rod for allowing the lifting rod to be adjusted to various lengths.

6. Apparatus as in claim 1 wherein said toilet seat attachment bracket comprises a substantially right angled piece that attaches to a toilet seat and to which in turn the lifting rod and pneumatic device are pivotally attached.

* * * * *